US009149671B2

(12) United States Patent
Hosfield et al.

(10) Patent No.: US 9,149,671 B2
(45) Date of Patent: Oct. 6, 2015

(54) COMPACT FIRE-EXTINGUISHING SYSTEM WITH HIGH-PRESSURE FOAM PROPORTIONING SYSTEM

(75) Inventors: Robert L. Hosfield, Centerville, MN (US); Michael Dupay, Minneapolis, MN (US); Kurt Mehrkens, Minneapolis, MN (US)

(73) Assignee: Fire Research Corp., Nesconset, NY (US)

( * ) Notice: Subject to any disclaimer, the term of this patent is extended or adjusted under 35 U.S.C. 154(b) by 1205 days.

(21) Appl. No.: 13/051,974

(22) Filed: Mar. 18, 2011

(65) Prior Publication Data

US 2011/0226494 A1 Sep. 22, 2011

Related U.S. Application Data

(60) Provisional application No. 61/315,342, filed on Mar. 18, 2010.

(51) Int. Cl.

| | |
|---|---|
| ***A62C 35/00*** | (2006.01) |
| ***A62C 5/02*** | (2006.01) |
| ***A62C 25/00*** | (2006.01) |

(52) U.S. Cl.
CPC .. *A62C 5/02* (2013.01); *A62C 25/00* (2013.01)

(58) Field of Classification Search
CPC ..... A62C 5/002; A62C 5/02
USPC ..... 169/14, 15, 16; 417/440, 307
See application file for complete search history.

(56) References Cited

U.S. PATENT DOCUMENTS

| | | | | |
|---|---|---|---|---|
| 3,047,003 | A | 7/1962 | Gurney | |
| 3,377,857 | A | 4/1968 | Moscarini | |
| 3,691,834 | A | 9/1972 | De Fasselle et al. | |
| 3,878,862 | A * | 4/1975 | Blanton | 137/553 |
| 3,974,879 | A | 8/1976 | Nelson, Jr. et al. | |
| 3,981,618 | A | 9/1976 | Nelson, Jr. | |
| 4,441,862 | A * | 4/1984 | Vogel | 417/250 |
| 5,009,244 | A | 4/1991 | Grindley et al. | |
| 5,086,654 | A | 2/1992 | Malminen | |
| 5,145,014 | A | 9/1992 | Eberhardt | |
| 5,174,383 | A | 12/1992 | Haugen et al. | |
| 5,232,052 | A | 8/1993 | Arvidson et al. | |
| 5,255,747 | A | 10/1993 | Teske et al. | |
| 5,411,100 | A | 5/1995 | Laskaris et al. | |
| 5,494,112 | A | 2/1996 | Arvidson et al. | |
| 5,515,734 | A * | 5/1996 | Malminen | 73/861.46 |
| RE35,362 | E | 10/1996 | Arvidson et al. | |
| 5,764,463 | A | 6/1998 | Arvidson et al. | |
| 5,765,644 | A | 6/1998 | Arvidson et al. | |
| 5,803,596 | A * | 9/1998 | Stephens | 366/10 |
| 5,881,818 | A | 3/1999 | Lee et al. | |
| 6,454,540 | B1 | 9/2002 | Terefinko et al. | |

(Continued)

*Primary Examiner* — Len Tran
*Assistant Examiner* — Joel Zhou
(74) *Attorney, Agent, or Firm* — Quarles & Brady LLP

(57) ABSTRACT

A compact, stand-alone fire-extinguishing system for use with a water source is disclosed. The fire-extinguishing system can include an engine, a pump, a foam tank, a flow meter, and a foamant adjustment valve. The flow meter can be a variable area flow meter and indicate an instantaneous concentration of a water-foamant solution. The foamant adjustment valve can be a needle valve. A head injector can be coupled to the pump. The head injector provides foamant to be mixed with water inside the pump to create a water-foamant solution. The fire-extinguishing system may also include an inlet mixing valve assembly and an unloader valve to recirculate the water-foamant solution.

12 Claims, 7 Drawing Sheets

(56) References Cited

U.S. PATENT DOCUMENTS

| | | | |
|---|---|---|---|
| 6,684,959 | B1 | 2/2004 | Juidici et al. |
| 6,733,004 | B2 | 5/2004 | Crawley |
| 6,761,226 | B2 | 7/2004 | Carrier et al. |
| 6,766,863 | B2 | 7/2004 | Arvidson et al. |
| 6,886,639 | B2 | 5/2005 | Arvidson et al. |
| 6,991,041 | B2 | 1/2006 | Laskaris et al. |
| 7,318,483 | B2 | 1/2008 | Arvidson et al. |
| 7,614,455 | B2 | 11/2009 | Arvidson et al. |
| 2003/0047327 | A1* | 3/2003 | Gilbert ..... 169/46 |
| 2007/0023088 | A1* | 2/2007 | Benson ..... 137/565.11 |
| 2007/0209807 | A1 | 9/2007 | Kruger et al. |
| 2007/0246230 | A1 | 10/2007 | Roberts |
| 2008/0035201 | A1 | 2/2008 | Roberts |
| 2008/0236846 | A1 | 10/2008 | Gamble et al. |
| 2009/0095492 | A1 | 4/2009 | Waters et al. |
| 2009/0200045 | A1 | 8/2009 | Hosfield et al. |

* cited by examiner

FIG. 2
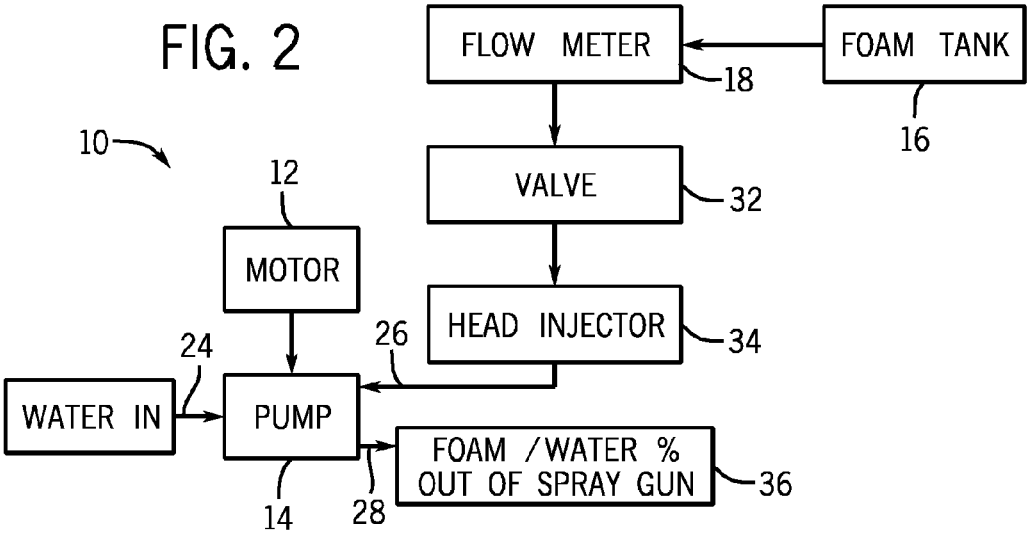
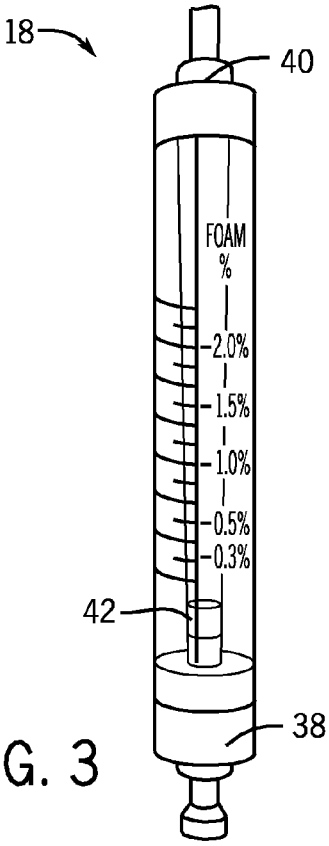
FIG. 3

COMPACT FIRE-EXTINGUISHING SYSTEM WITH HIGH-PRESSURE FOAM PROPORTIONING SYSTEM

CROSS REFERENCE TO RELATED APPLICATIONS

This application claims priority to U.S. Provisional Application No. 61/315,342 filed on Mar. 18, 2010. The entire disclosure of the prior application is considered part of the accompanying application and is hereby incorporated therein by reference.

BACKGROUND

Fire-extinguishing systems typically include bulky equipment to deliver large amounts of water. For smaller fires, the damage caused by the water sprayed inside the building is often worse than the damage caused by the fire itself. Most fire-extinguishing equipment is too bulky to enter a building or maneuver inside a building in order to direct water and foamant toward only the particular area of the building that is on fire. Conventional fire-extinguishing equipment is also often too bulky to maneuver inside a manufacturing plant or near homes in remote locations.

SUMMARY OF THE INVENTION

Some embodiments of the invention provide a compact, stand-alone fire-extinguishing system for use with a water source and includes a foam proportioning system. The fire-extinguishing system can include an engine, a pump driven by the engine, and a foam tank with foamant. The system can also include a flow meter measuring a flow rate of foamant from the foam tank and indicating an instantaneous concentration of a water-foamant solution to be discharged through the outlet. The system can further include a foamant adjustment valve that is adjustable to alter the flow rate of foamant. A head injector is coupled to the pump. The head injector receives foamant from the foam tank through the foamant adjustment valve. The head injector provides foamant to be mixed with water inside the pump to create the water-foamant solution that is discharged through the outlet of the pump.

In another embodiment, the invention provides a compact fire-extinguishing system that includes an engine and a pump driven by the engine. The pump is in fluid communication with a source of water and a source of foamant. The pump includes a first inlet, an outlet, and an inlet mixing valve assembly. The inlet mixing valve assembly can include a valve seat, a disc, and a spring coupled to the disc. The system can also include a foam tank that stores the foamant, a flow meter measuring a flow rate of foamant and indicating an instantaneous concentration of a water-foamant solution to be discharged through the outlet, and a foamant adjustment valve that is adjustable to alter the flow rate of foamant. The pump receives foamant at the first inlet and mixes the foamant with water to create the water-foamant solution that is discharged through the outlet. The inlet mix valve assembly can move between a closed position with the disc engaging the valve seat and an open position with the disc removed from the valve seat, the inlet mix valve assembly moving between the closed position and the open position based on an amount of fluid pressure in the pump.

These and other features, aspects, and advantages of the present invention will become better understood upon consideration of the following detailed description, drawings, and appended claims.

DESCRIPTION OF THE DRAWINGS

FIG. 2 is a schematic diagram illustrating flow paths through the fire-extinguishing system of FIG. 1.

FIG. 3 is a perspective view of a variable area flow meter according to one embodiment of the invention.

DETAILED DESCRIPTION

Figure 1:
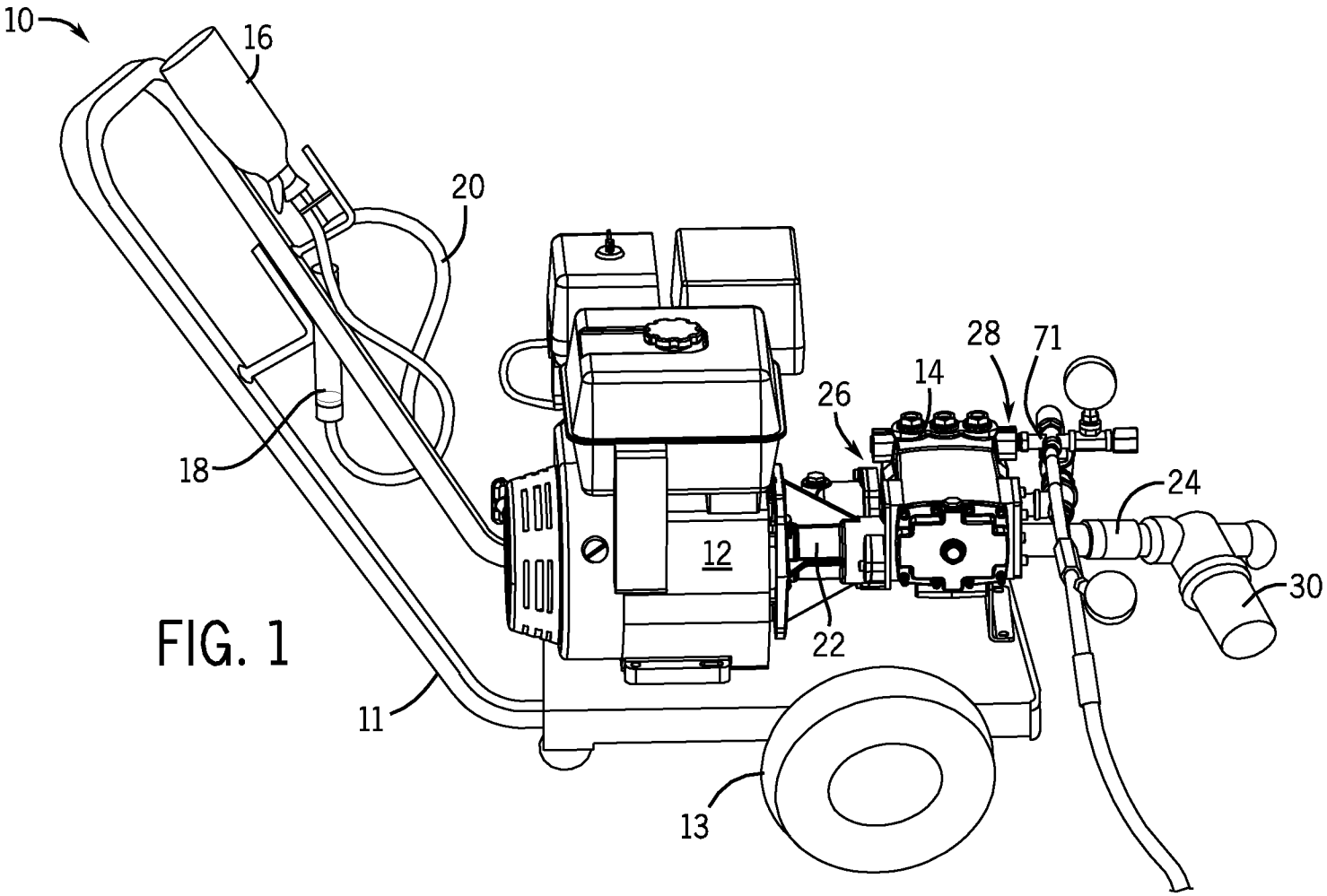
FIG. 1 is a perspective view of a fire-extinguishing system including a pump according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Some embodiments of the invention provide a compact, stand-alone, high-pressure foam proportioning system coupled with a variable area flow meter to provide a lightweight, easy-to-use, low-volume, accurate variable foam percentage injection and reliable foam injection system that can be used on all terrain vehicles and small trucks. The flow meter and the foamant adjustment valve provide the ability to measure the instantaneous foam rate into the system. Since the volumetric flow rate of the pump is known, the corresponding foam injection percentage is directly proportional to the metered foam flow rate input and water input. This allows the use of a foam percentage scaled indicator positioned on or around the flow meter with the total foam percentage indicated across from the foam injection flow rate on the meter. The foamant adjustment valve allows the injection percentage to be changed. Although a variable area flow meter and needle valve are used in the preferred embodiments, the foam injection percentage may be measured and altered with the use of other flow meters and/or valves.

FIG. 1 illustrates a compact fire-extinguishing system 10 according to one embodiment of the invention. The fire extinguishing system 10 can include an engine 12, a pump 14, a foam tank 16, and a flow meter 18 mounted to frame 11 with wheels 13. While the system 10 may be attached to a frame 11 with wheels 13 that may be pulled by a person, the system 10 is designed so that it could alternatively be attached to a frame of an off-road vehicle, such as an All-Terrain Vehicle, small pick-up truck, or the like, or the system 10 can be attached to a small trailer to be pulled by such an off-road vehicle. A foam line 20 can provide foamant from the foam tank 16 to the pump 14. The flow meter 18 can be positioned at any suitable location along the foam line 20. The engine 12 can include a gear box 22 to drive the pump 14 (e.g., using a 1.8 to 1 gear ratio). In one embodiment, the engine 12 is a 13 horse power Power Pro gas engine. In some embodiments, the engine 12 can be a gas combustion engine, while in other embodiments, the engine 12 can be an electric motor, a hydraulic motor, or another suitable engine or motor.

The pump 14 can be a plunger pump (e.g., a Hypro 2414B-P plunger pump) and can include a water inlet 24, a foam inlet 26, and an outlet 28. In operation, the pump 14 can receive a water stream from a source, such as a water tank, municipal hydrant, stream, and/or lake, through the water inlet 24. The water stream can pass through a filter 30 before entering the pump 14 in order to prevent damage to the pump 14 due to undissolved solids and/or other particles in the water stream. In one embodiment, a check valve can be used at the pump's cylinder inlet with a 0.3 cracking pressure and ⅜ inch NPT female check valve (e.g., as available from McMaster-Carr®). At the outlet 28 of the pump 14, there are pressure gauges and an unloader valve 71 to measure pressure and divert flow when the system is not spraying.

In some embodiments, the pump 14 can receive a foamant from the foam tank 16 through the foam inlet 26. The pump 14 can mix the foamant into the water stream and dispense a water-foamant solution through the outlet 28. In some embodiments, water can be dispensed through the outlet 28 with very little or no foamant. The term "foamant" as used herein and in the appended claims can include anyone or more of the following: liquid chemical foams, concentrates, water additives, emulsifiers, gels, and additional suitable substances.

FIG. 2 illustrates flow paths for the water stream and the foamant through the fire extinguishing system 10 according to one embodiment of the invention. The pump 14 driven by the engine 12 can draw the water stream through the water inlet 24. The foamant stored in the foam tank 16 can pass through the flow meter 18, a foamant adjustment valve 32, and a head injector 34 before flowing into the pump 14 through the foam inlet 26. An orifice or hole inside the water inlet 24 of the pump 14 can create a vacuum in the pump 14, while still allowing the pump 14 to operate at maximum efficiency. The foamant adjustment valve 32 can adjust the amount of foamant entering the pump 14. The pump 14 can discharge the water-foamant solution through the outlet 28 to a spray gun 36.

As shown in FIG. 3, the flow meter 18 can be a vertical cylinder that is calibrated to read flow rate and the percentage of foam concentrate entering the system based on the pump 14 output. The scaled lines on the flow meter 18 display the corresponding foam percentage to the foam inlet 26. This value is obtained by the fact that the pump flow rate is known at a given maximum revolutions per minute (e.g., at 1725 RPM the pump flow rate is 8 GPM), because the injection percentage is directly related to the injection flow rate. The flow rate can be indicated with a float 42 inside the flow meter 18. The position of the float can also be read digitally if desired to indicate an injection percentage. In general, the flow meter 18 measures instantaneous flow rate by means of a head injection.

The flow meter 18 can indicate an instantaneous amount of foamant being added to the water stream. In some embodiments, the flow meter 18 can be a variable-area flow meter or a rotameter, however, other types of flow meters known in the art may be used to accomplish the same result as the variable-area flow meter. The flow meter 18 can be from BLUE-WHITE® INDUSTRIES located in Huntington Beach, Calif. The flow meter 18 can include a bottom end 38, a top end 40, and a float 42. The bottom end 38 can be in fluid communication with the foam tank 16 and the top end 40 can be in fluid communication with the foam inlet 26 of the pump 14. As a result, the foamant can flow through the flow meter 18 against gravity. The float 42 can be used to indicate a flow rate of the foamant. In some embodiments, the flow meter 18 can be calibrated in order to also indicate a concentration of the water-foamant solution.

Figure 4:
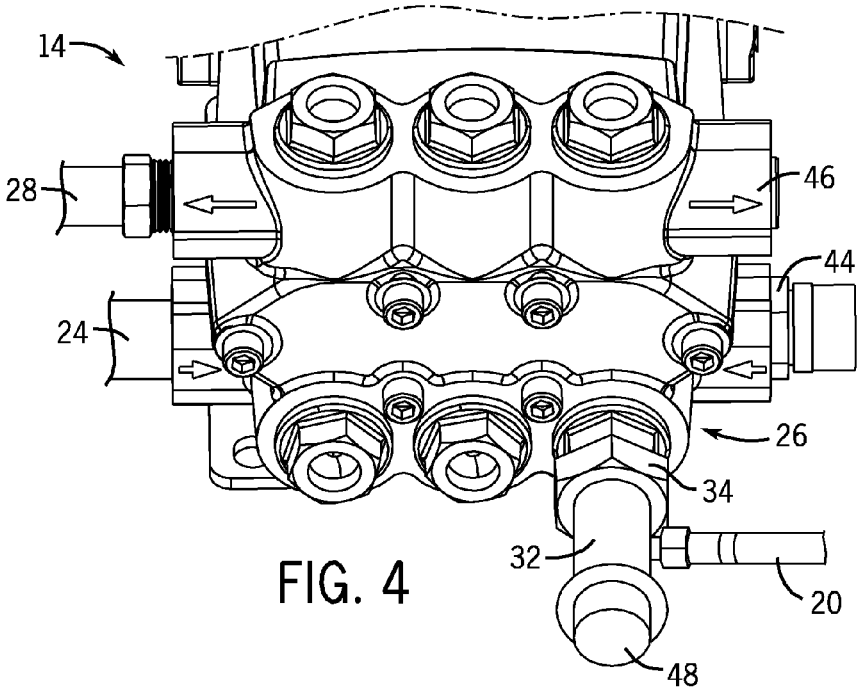
FIG. 4 is a front view of the pump of FIG. 1.

FIG. 4 illustrates the plunger pump 14 according to one embodiment of the invention. The pump 14 can include the water inlet 24, the foam inlet 26, and the outlet 28. In some embodiments, the pump 14 can include an alternate water inlet 44 and an alternate outlet 46. The pump 14 can draw the water stream through the water inlet 24 and/or the alternate water inlet 44 and can dispense the water-foamant solution through the outlet 28 and/or the alternate outlet 46. In some embodiments, the water inlet 24 or the alternate water inlet 44 and the outlet 28 or the alternate outlet 46 can be closed. In some embodiments, the water inlet 24, the outlet 28, the alternate water inlet 44, and the alternate outlet 46 can provide several versatile mounting positions and can increase the number of possible mounting locations for various applications of the fire-extinguishing system 10. In other embodiments, the water inlet 24 and the alternate water inlet 44 can provide two water streams from different sources. For example, the water inlet 24 can be in fluid communication with a water tank and the alternate water inlet 24 can draw water from a municipal hydrant.

In some embodiments, the head injector 34 can be coupled to the foam inlet 26 of the pump 14. The head injector 34 and the foamant adjustment valve 32 can be in fluid communication with the foam tank 16. The foamant adjustment valve 32 may be a needle valve, however, it is contemplated that other types of valves, such as a globe valve, may be used to adjust the flow rate of foamant. The needle valve 32 can be positioned upstream of the head injector 34. The needle valve 32 can be used to meter an amount of the foamant flowing through the foam line 20 and/or the head injector 34 into the pump 14. In some embodiments, the needle valve 32 can include a dial 48 to adjust the flow rate.

Figure 5:
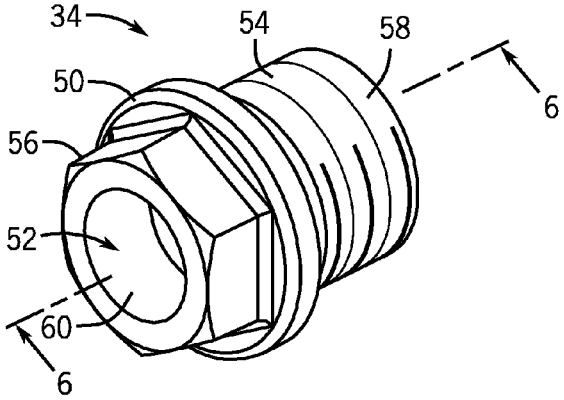
FIG. 5 is a perspective view of a head injector for use with the pump of FIG. 4.
Figure 6:
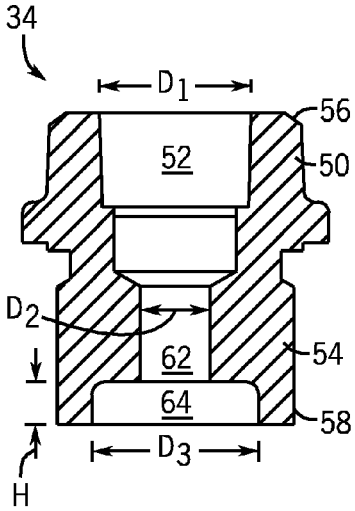
FIG. 6 is a cross-sectional view of the head injector of FIG. 5.

FIGS. 5 and 6 illustrate the head injector 34 according to one embodiment of the invention. The flow rate of foam into the head injector 34 of the pump 14 is metered by the flow meter 18. As shown in FIG. 5, the head injector 34 can include a screw head 50, a flow passage 52, and a fitting 54. The screw head 50 can be positioned adjacent to a first end 56 of the head injector 34 and the fitting 54 can be positioned adjacent to a second end 58 of the head injector 34. In some embodiments, the fitting 54 can be coupled to the foam inlet 26 of the pump 14. The fitting 54 can be dimensioned in order to avoid causing a pump chamber of the pump 14 to cavitate. In some embodiments, the screw head 50 can include a sealing surface 60 for engagement with the valve 32 and/or other components of the fire-extinguishing system 10.

As shown in FIG. 6, the flow passage 52 can extend through the head injector 34. The flow passage 52 can include a first diameter D1 adjacent to the first end 56. The flow passage 52 can transition to an orifice 62 having a second diameter D2 downstream of the first end 56. In some embodiments, the second diameter D2 can be substantially smaller than the first diameter D1. In some embodiments, the flow passage 52 can taper from the first diameter D1 to the second diameter D2. In other embodiments, the flow passage 52 can include one or more steps. The flow passage 52 can be designed to create a pressure differential within the head injector 36 with respect to a location upstream of the head injector 34. In some embodiments, the pressure differential can be negative so that the foamant can be pulled into the pump 14 by suction. In some embodiments, the pressure differential between the pressure within the head injector 34 and upstream of the head injector 34 can be optimized in order to avoid decreasing the performance of the pump 14. In some embodiments, the pressure differential can be less than about 5 inches of mercury (Hg).

In some embodiments, the flow passage 52 can include a chamber 64 having a third diameter D3 and a height H. The chamber 64 can be positioned adjacent to the second end 58 and/or downstream of the orifice 62. In some embodiments, the third diameter D3 can be substantially larger than the second diameter D2. In some embodiments, the third diameter D3 can also be substantially larger than the first diameter D1. The transition from the second diameter D2 to the third diameter D3 can be stepped or otherwise abrupt. The height H can be substantially smaller than the third diameter D3.

Figure 7:
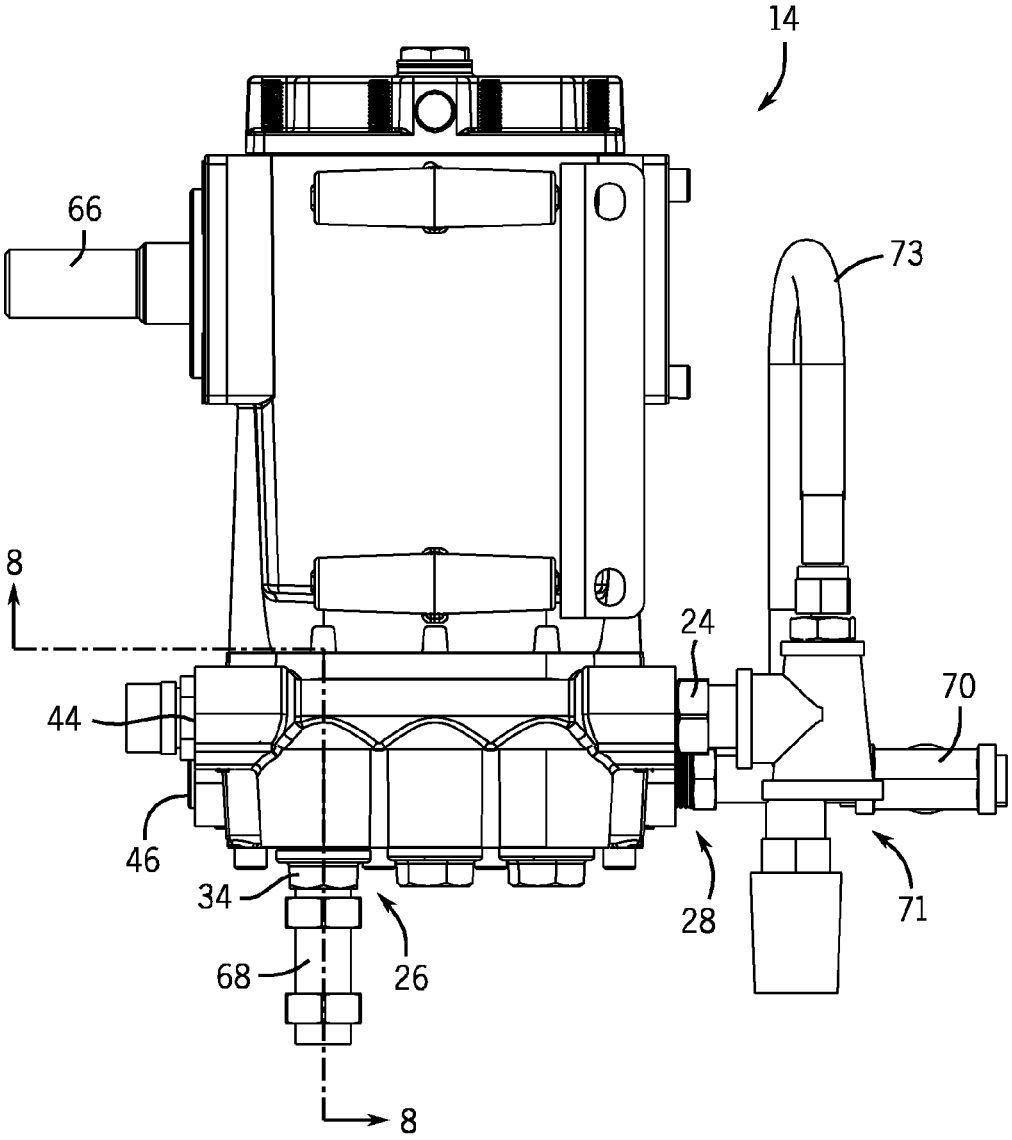
FIG. 7 is a bottom view of the pump of FIG. 4.

FIG. 7 is a bottom view of the pump 14 including the water inlet 24, the foam inlet 26, and the outlet 28. The pump 14 can include a shaft 66 to couple the pump 14 to the engine 12 and/or the gear box 22. A check valve 68 can be positioned upstream of the foam inlet 26 in order to prevent the water-foamant solution to flow back into the foam line 20. In some embodiments, the check valve 68 can be coupled to the head injector 34. The outlet 28 can include a pressure gauge 70 indicating the pressure at which the water-foamant solution is being dispensed. The outlet 28 may also include an unloader valve 71 and a return line 73, which will be discussed in further detail below.

Figure 8:
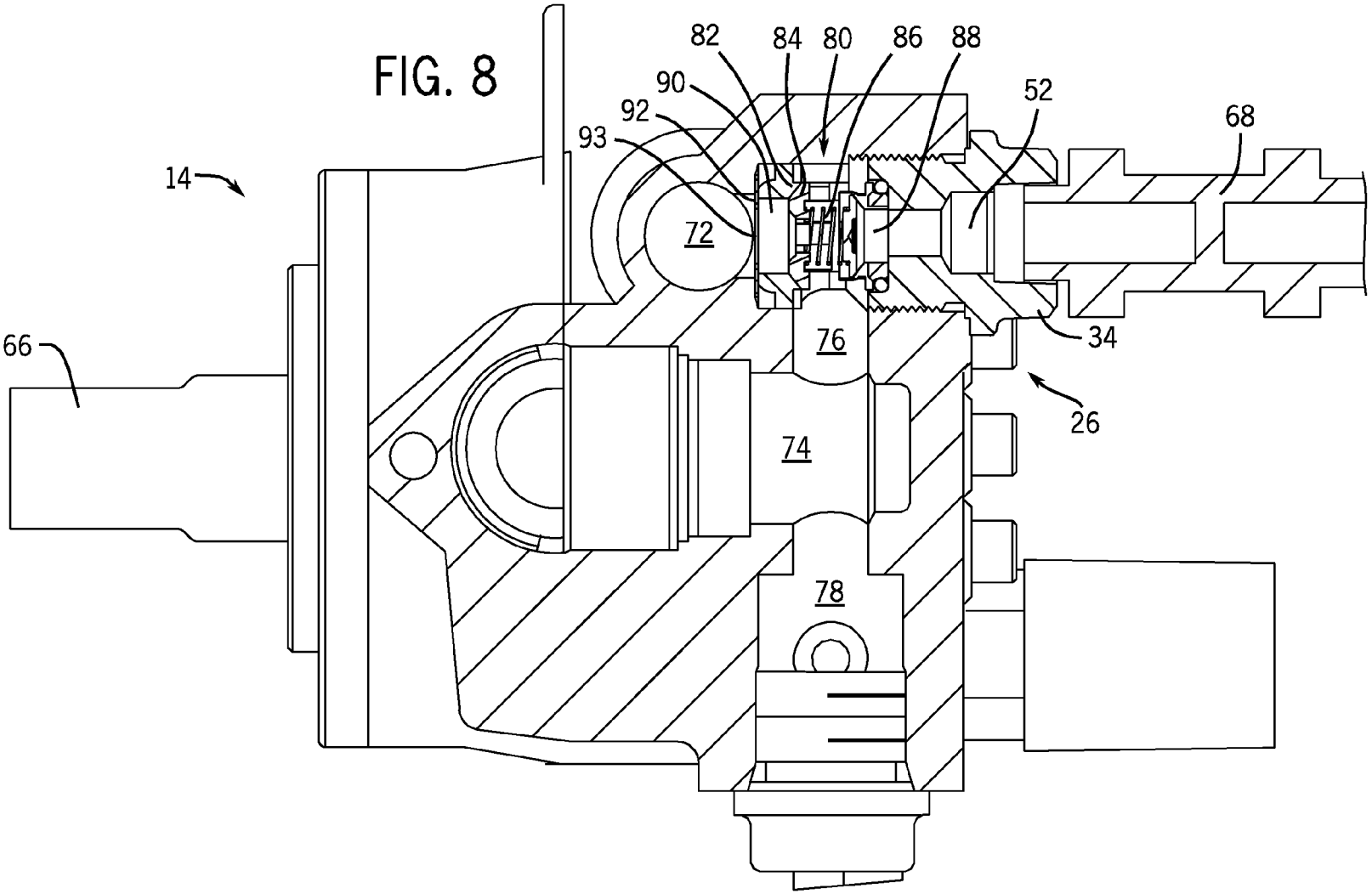
FIG. 8 is a cross-sectional view of the pump of FIG. 4.

FIG. 8 illustrates a cross section of the pump 14 according to one embodiment of the invention. The cross-section is taken along line 8-8 of FIG. 7. The pump 14 can include a passage 72 and a pump chamber 74 having an inflow 76 and an outflow 78. The inflow 76 can be in fluid communication with pre-stage pump chambers, the water inlet 24, and/or the alternate water inlet 44. The outflow 78 can be in fluid communication with additional pump chambers and/or the passage 72. The passage 72 can be in fluid communication with the outlet 28 and/or the alternate outlet 46. In some embodiments, the passage 72 can provide fluid communication with the foam inlet 26.

In some embodiments, an inlet mix valve assembly 80 can be positioned adjacent to the inlet passage 72 and/or the foam inlet 26. The inlet mix valve assembly 80 can include an open position and a closed position. When an operator dispenses the water-foamant solution, the inlet mix valve assembly 80 can be closed and the water-foamant solution can exit through the passage 78 dispensing the water-foamant solution. If the operator interrupts the fire-fighting operation, the inlet mix valve assembly 80 can open and the pump 14 can recirculate the water-foamant solution back to the pump chamber 74 through unloader valve 71 and return line 73. If the operator continues the fire-fighting operation, the inlet mix valve assembly 80 can return to its closed position.

The inlet mix valve assembly 80 can include a valve seat 82, a disc 84, a spring 86, and a restrictor plate 92. The inlet mix valve assembly 80 can engage the head injector 34. In some embodiments, the inlet mix valve assembly 80 can be inserted into the chamber 64 (as shown in FIG. 6) of the head injector 34. The inlet mix valve assembly 80 can include a first inlet 88 and a second inlet 90. In the closed position of the inlet mix valve assembly 80, the first inlet 88 enables fluid communication between the foam inlet 26 and the inflow 76 of the pump chamber 74. The second inlet 90 is in fluid communication with passage 72. A hole 93 in restrictor plate 92 is sized to slightly restrict the flow in the second inlet 92 without cavitating the cylinder.

As water is introduced into the pump 14 and water-foamant solution is being dispensed, water will press disc 84 against spring 86 such that water will enter the chamber of the pump 74 and a vacuum created in the pump 14 draws foamant into inlet 88 from flow passage 52. As a result, the inlet mix valve assembly 80 enables foamant from the foam inlet 26 to enter the pump chamber 74 where the foamant can be mixed with the water stream before being dispensed through the outlet 28 and/or the alternate outlet 46 of the pump 14.

If no water-foamant solution is being dispensed from the fire-extinguishing system 10, the pressure inside passage 72 increases. The pressure can push the disc 84 of the inlet mix valve assembly 80 toward the first inlet 88 in order to open the inlet mix valve assembly 80. As a result, the water-foamant solution can be routed through the second inlet 90. In some embodiments, the spring 86 can determine the pressure at which the inlet mix valve assembly 80 opens. In some embodiments, the pressure at which the inlet mix valve assembly 80 opens can be adjusted, so that the inlet mix valve assembly 80 can be set to operate at a suitable pressure.

In the open position, the inlet mix valve assembly 80 along with the unloader valve 71 can circulate the water-foamant solution from the passage 72 toward the inflow 76 of the pump chamber 74. As the water-foamant solution exits the outlet 28 of the pump, the unloader valve 71 recirculates the water-foamant solution through return line 73, with the water inlet 24 including a check valve to keep the water-foamant solution recirculating to the pump 14. Disc 84 of the inlet mix valve assembly 80 blocks the first inlet 88, preventing additional foamant from being added through the foam inlet 26. As a result, the concentration of the water-foamant solution remains substantially constant while the pump 14 recirculates the water-foamant solution. In addition, the unloader valve 71 keeps this recirculation of the water-foamant solution in the pump at a low pressure and maintains the pressure downstream towards the sprayer to keep the fire-extinguishing system 10 primed for operation. This helps to reduce start-up time between usage intervals of the fire-extinguishing system 10 so the system 10 is ready to resume fire-fighting operations after each interruption in demand. Furthermore, the ability of the fire-extinguishing system 10 to allow for intermittent operation reduces usage of the water-foamant solution compared to conventional systems.

Figure 9:
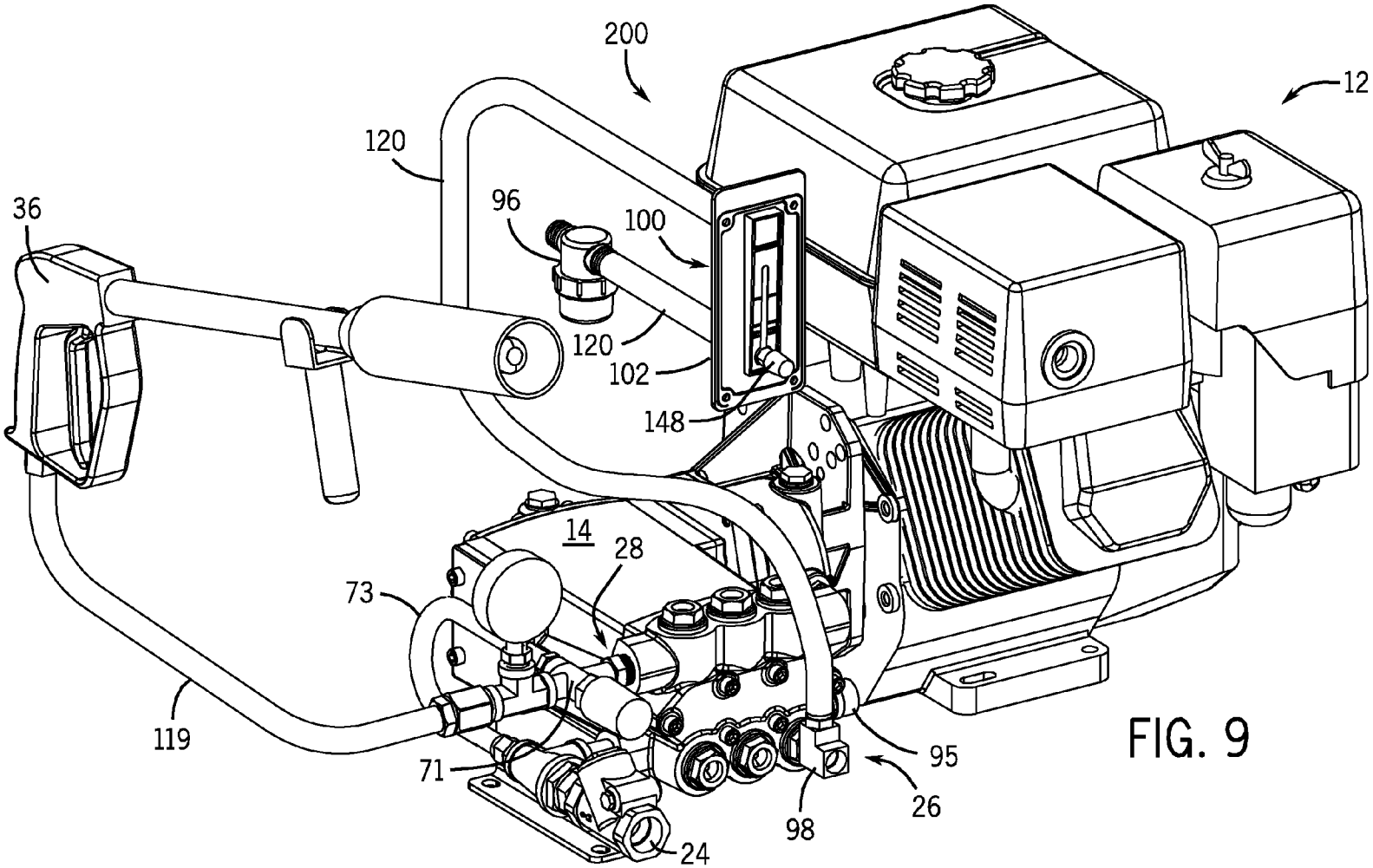
FIG. 9 is a perspective view of the fire-extinguishing system of FIG. 1 including a flow-meter assembly according to one embodiment of the invention.

FIG. 9 illustrates an alternative embodiment of the fire-extinguishing system 200 that has a flow meter assembly 100. The fire-extinguishing system 200 includes the engine 12, the pump 14, and the spray gun 36. The pump 14 can include the water inlet 24, the foam inlet 26, and the outlet 28. The water outlet 24 may be in fluid communication with a source of water. An outlet hose 119 may couple to an unloader valve 71 at the outlet 28 and couple to the spray gun 36. Although only one spray gun 36 is shown in FIG. 9, in other embodiments a selector valve (not shown) can be coupled to the outlet 28 to direct the water-foamant solution exiting the outlet 28 to different discharges devices, which may include more than one spray gun 36 and/or a spigot (not shown). The spigot can be used to calibrate the fire extinguishing system 200. The fire-extinguishing system 200 also includes a thermal relief valve 95 coupled to pump 14. The thermal relief valve 95 may be used to relieve the water-foamant solution from the pump during recirculation if a specified temperature is reached in order to prevent damage to the pump 14.

As shown in FIG. 9, the fire-extinguishing system 200 can include a flow-meter assembly 100. The flow-meter assembly 100 can be coupled to a mounting plate 102 that may be mounted to a frame or other structure in a location that is convenient for viewing and provides good accessibility for adjusting the foamant concentration. Unlike the previous embodiment, where the foamant adjustment valve 32 and flow meter 18 were separated and the foam adjustment valve 32 was near the foamant inlet 26, flow-meter assembly 100 includes a flow meter 118 and a foamant adjustment valve 132 in close proximity. The flow meter 118 can be a variable-area flow meter, as described above. The foamant adjustment valve 132 can include a dial 148 to adjust a flow rate of foamant through the valve 132. In some embodiments, the foamant adjustment valve 132 can be a needle valve. The flow-meter assembly 100 can be readily available from DWYER® INSTRUMENTS located in Michigan City, Ind.

Figure 10:
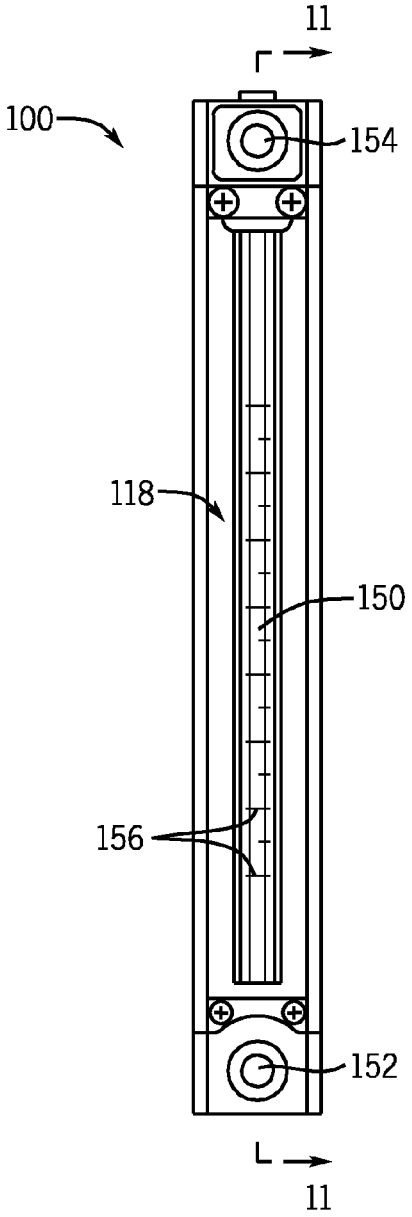
FIG. 10 is a back view of the flow-meter assembly of FIG. 9.

FIG. 10 illustrates a back view of the flow-meter assembly 100 according to one embodiment of the invention. The flow-meter assembly 100 can include a window 150, an inflow 152, and an outflow 154. The window 150 can include one or more scaled lines 156 indicating the flow rate of the foamant and/or the concentration of the water-foamant solution, which may be calculated as described above. In some embodiments, the scaled lines 156 can indicate the concentration of the water-foamant solution according to a flow rate through the pump 14 and/or a speed at which the pump 14 is driven.

Figure 11:
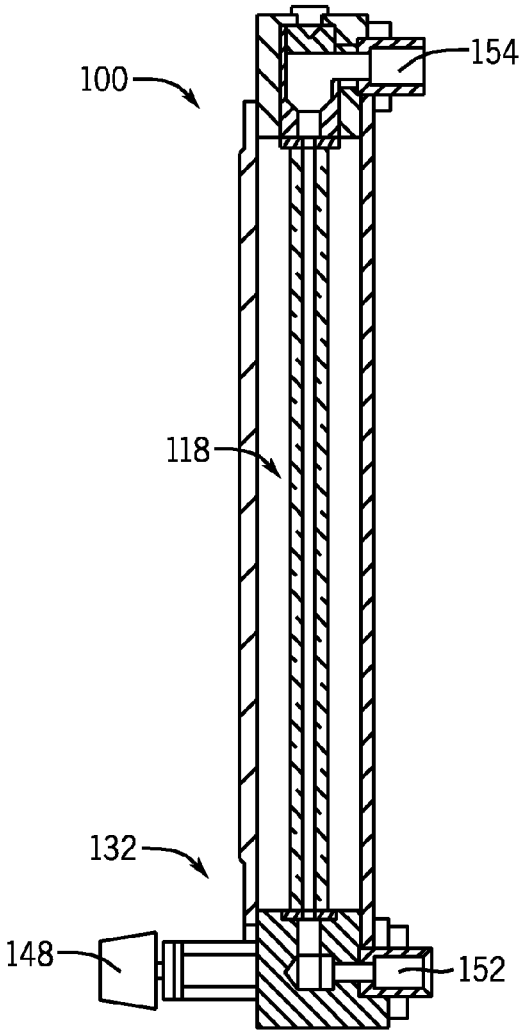
FIG. 11 is a cross-sectional view of the flow-meter assembly of FIG. 9.

FIG. 11 is a cross-sectional view of the flow-meter assembly 100 taken along a line 11-11 in FIG. 10. In some embodiments, the valve 132 can be positioned adjacent to the inflow 152 in order to regulate the flow rate through the flow-meter assembly 100. In some embodiments, the flow-meter assembly 100 can be resistant to the corrosive properties of the foamant. In some embodiments, the flow meter 118 of the flow-meter assembly 100 can be at least partially manufactured from glass.

Referring back to FIG. 9, the fire-extinguishing system 200 can include foam lines 120. One end of the foam line 120 may be coupled to a strainer 96 for intaking foamant. The foamant passes through the foam line 120 and into inflow 152 of the flow-meter assembly 100, through the flow meter 118, and out of the outflow 154 and into a downstream foam line 120. The foamant may then pass to foam inlet 26 on the pump 14 via fitting 98. Internal to the foam inlet 26 and coupled to fitting 98 may be the head injector 34 and check valve 68, as described above.

The fire-extinguishing systems 10, 200 provide a light weight and compact system, which can serve as a stand-alone system or can be mounted to vehicles, including, but not limited to, wheeled carts, all-terrain vehicles (ATV), or pick-up trucks. The fire-extinguishing system 10 can be easy to use in order to provide efficient fire-fighting capabilities to untrained personnel, for example, workers in a manufacturing plant or home owners living in remote locations. The fire-extinguishing system 10 can provide reliable, accurate, and low-volume foam injection, while complying with National Fire Protection Association (NFPA) standards.

The engine 12 can operate the pump 14 at a substantially constant speed over the course of the fire-fighting operation. The speed at which the pump 14 is operated can be influenced by the gear box 22 and/or the speed of the engine 12. In some embodiments, the flow rate through the pump 14 can be proportional to the speed of the engine 12. In some embodiments, the pump 14 can be a positive displacement pump. For a given speed, the flow rate through the pump 14 can be known.

In some embodiments, the fire-extinguishing system 10 can discharge the water-foamant solution at up to about 2,500 pounds per square inch (PSI) and a flow rate of up to about 8 gallons per minute (GPM). The foamant adjustment valves 32, 132 can enable flow rates of the foamant ranging from substantially 0 GPM to about 0.5 GPM, resulting in a concentration of the water-foamant solution of up to about 6%. In some embodiments, the valves 32, 132 can substantially continuously adjust the flow rate of the foamant and/or the concentration of the water-foamant solution within the range of about 0% to about 6%.

One advantage of the invention is that the fire-extinguishing system is capable of being attached to all terrain vehicles or small trucks to be used in areas where conventional fire-extinguishing equipment may not be able to access. As long as a source of water is accessible, the system may provide a water-foamant solution to extinguish a fire.

Furthermore, due to the compactness and stand-alone nature of this system, the system may be used by individuals as an on-site fire-extinguishing system to contain or extinguish fires before conventional fire-fighting crews may reach the site of a fire, thus reducing the damage of a fire due to the travel time associated with fire-extinguishing crews and conventional equipment.

Another advantage of the present invention is that the flow meter and foam adjustment valve allow a user to accurately meter instantaneous foam injection rates into a compact, stand-alone fire-extinguishing system. This allows a user to adjust the foam concentration in the water-foamant solution based on the circumstances at hand.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A stand-alone, vehicle mountable fire-extinguishing system for use with a water source, the fire extinguishing system comprising:

an engine;

a pump driven by the engine, the pump receiving water from the water source, the pump including an outlet;

a foam tank that stores foamant;

a flow meter measuring a flow rate of foamant from the foam tank and indicating an instantaneous concentration of a water-foamant solution to be discharged through the outlet;

a foamant adjustment valve being adjustable to alter the flow rate of foamant;

a head injector in fluid communication with the pump, the head injector receiving foamant from the foam tank through the foamant adjustment valve, the head injector providing foamant to be mixed with water inside the pump to create the water-foamant solution that is discharged through the outlet;

an inlet mix valve assembly, the inlet mix valve assembly moving between a closed position with a disc engaging a valve seat and an open position with the disc removed from the valve seat; and an unloader valve and a return line, the open position recirculating the water-foamant solution in the pump, the unloader valve, and the return line in order to sustain a substantially constant water-foamant concentration in the pump and to keep the fire-extinguishing system primed, the closed position allowing the water-foamant solution to discharge from the fire extinguishing system.

2. The fire-extinguishing system of claim 1, wherein the fire-extinguishing system is designed in order to be attached to a frame of an off-road vehicle to service a remote location.

3. The fire-extinguishing system of claim 1, wherein the flow meter is a variable area flow meter.

4. The fire-extinguishing system of claim 1, wherein the foamant adjustment valve is a needle valve.

5. The fire-extinguishing system of claim 4, wherein the needle valve includes a dial in order to alter the flow rate of foamant flowing into the head injector.

6. The fire-extinguishing system of claim 1, wherein the head injector includes a flow passage providing a lower pressure than at an intake of the head injector.

7. The fire-extinguishing system of claim 1, wherein the pump includes a first inlet and a second inlet, the foamant entering the pump through the first inlet and water entering the pump through the second inlet.

8. The fire-extinguishing system of claim 7, wherein the head injector is positioned in the first inlet and the pump includes a passage in fluid communication with the first inlet and the outlet.

9. The fire-extinguishing system of claim 1, further including a spring, wherein the spring determines the amount of fluid pressure in the pump necessary to move the inlet mixing valve assembly from the closed position to the open position or from the open position to the closed position.

10. The fire-extinguishing system of claim 1, wherein the inlet mixing valve assembly is adjustable such that the amount of fluid pressure in the pump necessary to move the inlet mixing valve assembly from the open position to the closed position and the closed position to the open position may vary.

11. The fire-extinguishing system of claim 1, further including a thermal relief valve coupled to the pump in order to prevent the pump from overheating.

12. The fire-extinguishing system of claim 1, the inlet mixing valve assembly including a restrictor plate with a hole and the inlet mixing valve assembly positioned adjacent to at least one of a passage in the pump or the first inlet.

* * * * *